US006189539B1

(12) United States Patent
Mitchell

(10) Patent No.: US 6,189,539 B1
(45) Date of Patent: Feb. 20, 2001

(54) NAIL POLISH CLEANUP STICKS HAVING MOISTURE-RETAINING PACKAGE

(76) Inventor: Sandrell Mitchell, 660 S. Glassell, Apt. 66, Orange, CA (US) 92826

( * ) Notice: Under 35 U.S.C. 154(b), the term of this patent shall be extended for 0 days.

(21) Appl. No.: 09/628,917

(22) Filed: Jul. 31, 2000

(51) Int. Cl.[7] ..... A45D 29/17
(52) U.S. Cl. ..... 132/73
(58) Field of Search ..... 132/73; 604/1; 15/208, 209.1, 210.1; 206/361

(56) References Cited

U.S. PATENT DOCUMENTS 2,902,146 * 9/1959 Doherty .
3,014,579 * 12/1961 Lathrop .
3,818,911 * 6/1974 Fournier .
4,740,194 * 4/1988 Barabino et al. ..... 604/3
4,887,994 * 12/1989 Bedford ..... 604/1
5,044,383 * 9/1991 Alessio et al. ..... 132/73
5,320,217 * 6/1994 Lenarz ..... 206/209

* cited by examiner

*Primary Examiner*—Jeffrey A. Smith
(74) *Attorney, Agent, or Firm*—Roy A. Ekstrand

(57) ABSTRACT

An elongated stick supports an interior end and an exterior end and is formed of a some what resilient but largely rigid material such as wood or plastic or the like. The interior end of the sticks supports a quantity of absorbent material formed in a shaped pad. A moisture-retaining package encloses the interior end of the stick and the absorbent pad to form a moisture-retaining pocket there about. A quantity of nail polish removing solvent such as acetone is absorbed and retained within the absorbent pad. A small quantity of excess solvent may also be enclosed within the moisture-retaining pocket.

5 Claims, 2 Drawing Sheets

Figure 6:
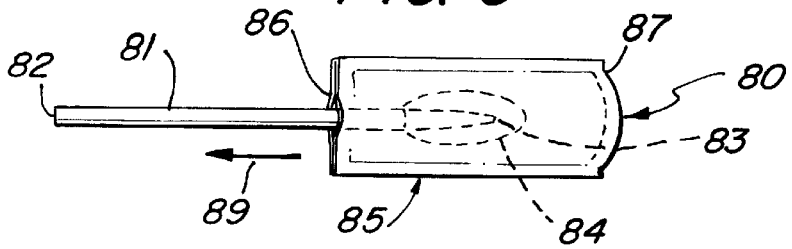

FIG. 1
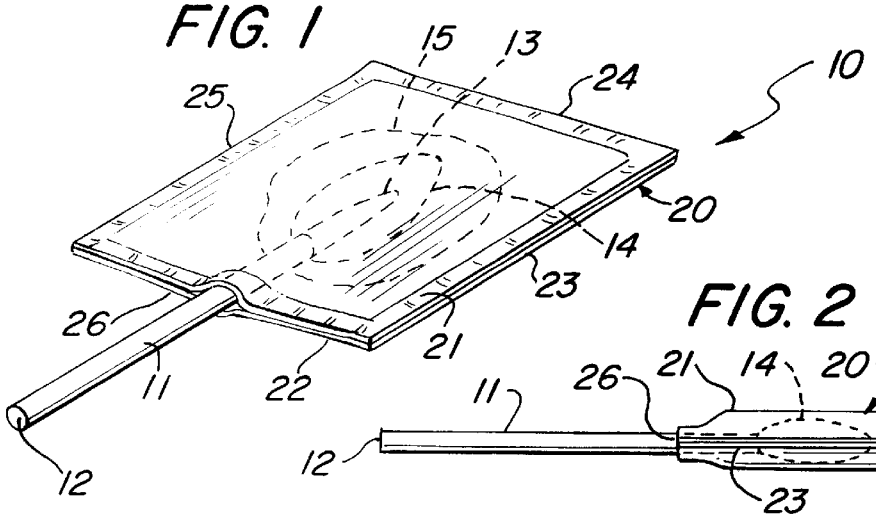
FIG. 2
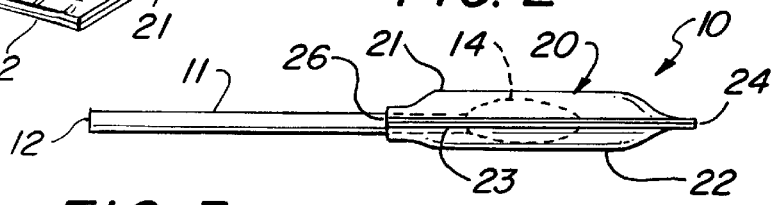
FIG. 3
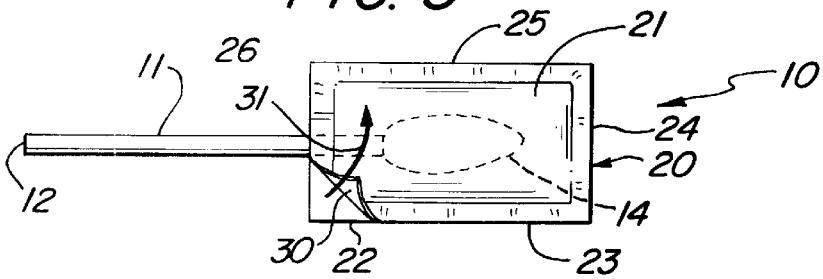
FIG. 4
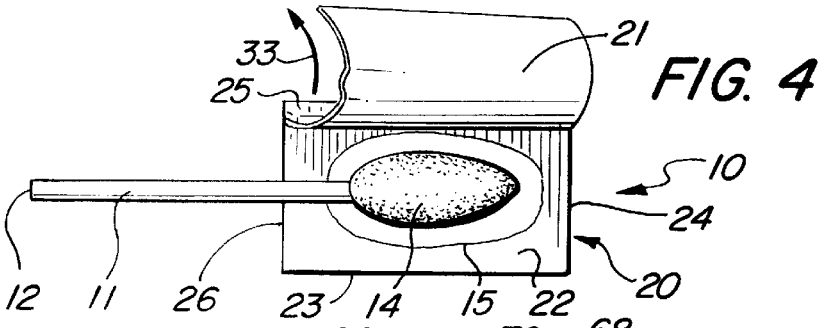
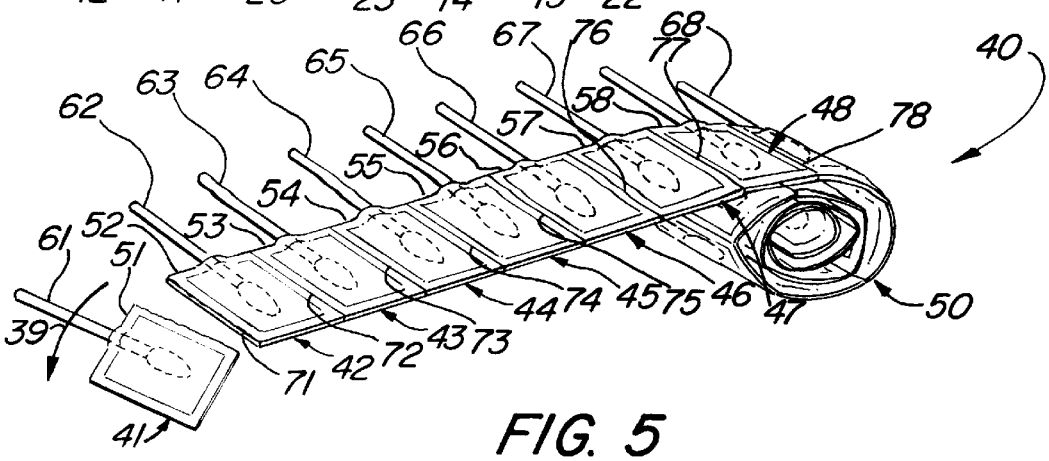
FIG. 5

NAIL POLISH CLEANUP STICKS HAVING MOISTURE-RETAINING PACKAGE

FIELD OF THE INVENTION

This invention relates generally to the practice of decorating and polishing human nails and particularly to apparatus for cleaning up or removing inadvertent excesses of nail polish from surrounding skin.

BACKGROUND OF THE INVENTION

The practice of painting and otherwise decorating fingernails and toenails is well known in the art and has been practiced in a variety of cultures in different ways for many years. During this long period of time, women have variously decorated their finger and toe nails with a variety of materials. While in some instances complex and even costly materials including decals, hand painted images, gold leaf or even precious stones have been utilized, the majority of nail decorating involves coating the nails with a high luster paint-like generally referred to as "nail polish".

The process of "polishing" nails is to some extent a misnomer in that the process is more correctly likened to a painting process. This nail polishing process is deceptively simple in its description but is often subject to a substantial skill requirement to provide satisfying results. For the most part, the process of polishing and painting nails involves initially cleaning the nails and removing all previous nail polish. An additional step of filing and shaping and trimming often also is carried forward. Once the nails are prepared one or more coats or layers of nail polish are successively applied. The nail polish is usually air-dried and the nail polish typically cures to a high luster.

It is during this process of applying one or more layers of nail polish to the prepared nails that the need for the above described invention arises. All to often, even the most skilled of nail polish practitioners or amateurs inadvertently apply small amounts of nail polish to the skin areas surrounding the nails. Unfortunately, the process of cleaning the surrounding skin and removing such inadvertently displaced nail polish may result in ruining the nail polish layer itself. Thus, substantial care and precision is exercised in cleaning surrounding skin and removing excess undesired nail polish.

In resent years, nail decorating has advanced to include so-called "artificial" nails. Such nails utilize simulated nails formed of a synthetic material which are shaped to fit upon and overlie the user's natural nails. Artificial nails are often carefully shaped to precisely fit upon the natural nail and are secured thereto with a specialized adhesive. Once the artificial nail has been adhesively secured, the above described nail painting process may be carried forward.

One vexing problem associated with decorating nails results from the manner in which human nails grow outwardly from the cuticle skin surrounding the interior portion of the nail. This outward growth creates a gap between the inner edge of the artificial nail and the cuticle. Painting natural nails is subject to a similar difficulty in that the interior edge of the nail polish layer is also moved away from the cuticle during growth forming a gap between the cuticle and the nail polish edge.

In natural nails, this gap is usually cared for during the process of removing old nail polish and replacing it with new polish as described above. In the case of artificial nails, an additional step of filling the physical gap between the artificial nail inner edge and the cuticle takes place prior to cleaning and repolishing.

Regardless of the type of nail used, natural or artificial, the above mentioned difficulties associated with cleaning excess polish from the surrounding skin of the nail must be carefully undertaken. Typically, a practitioner utilizes one or more so-called cosmetic sticks which are well known and include a simple elongated resilient or rigid member having an end portion covered with an absorbent material such as cotton or the like. This absorbent material is soaked in a solvent such as acetone and is used to carefully dissolve and remove excess nail polish.

Some practitioner's, particularly professionals, operate with greater precision using cleaning sticks which they form as needed by winding absorbent cotton material upon the ends of a variety of differently sized and shaped cleaning sticks. Thereafter, these absorbent ends are dipped in solvent and used as necessary. Unfortunately, whether used by professionals or amateurs, the process of soaking the absorbent ends of cleaning sticks in solvent is some what messy and time consuming. In addition, women often find themselves needing to touch up or even fully polish their nails in difficult inconvenient situations such as traveling or the like. Under such conditions, a container of solvent and the process of soaking the absorbent end of cleaning stick is extremely inconvenient and often difficult to perform. Further, there are certain environments in which the opening of a container of a volatile material such as acetone or other solvents is not permitted.

Accordingly, there arises a need in the art for a more convenient method of cleaning excess nail polish from the surrounding skin using a apparatus which is equally convenient and easy to carry and use.

SUMMARY OF THE INVENTION

Accordingly, it is a general object of the present invention to provide an improved apparatus for cleaning excess nail polish from the surrounding skin of a fingernail or toenail. It is a more particular object of the present invention to provide an improved apparatus for exercising such nail polish clean up which is particularly advantageous in situations such as traveling or the like.

In accordance with the present invention there is provided a nail polish cleanup stick having a moisture-retaining package comprising: an elongated stick having an interior end and an exterior end; a pad of absorbent material supported upon the interior end; a moisture-retaining package defining an interior pocket enclosure and sealed outer edges, the interior end and absorbent pad extending into the interior pocket; and a small quantity of nail polish dissolving solvent absorbed into the absorbent pad, the elongated stick and the absorbent pad being removable from the moisture-retaining package to apply the solvent to excess nail polish from a user's skin.

BRIEF DESCRIPTIONS OF THE DRAWINGS

Figure 7:
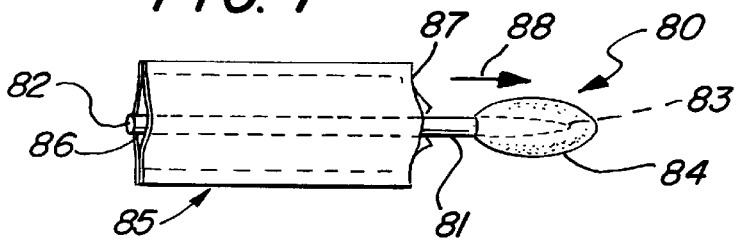
Figure 8:
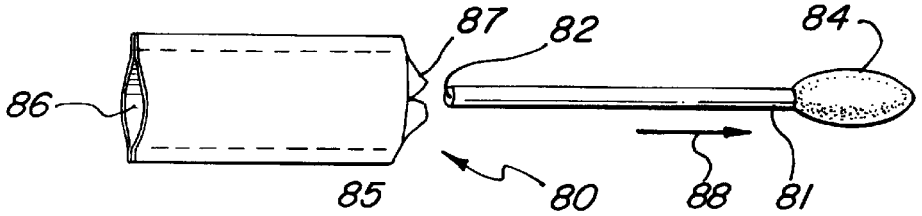
Figure 9:
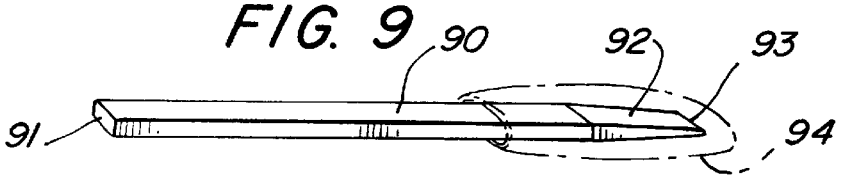
Figure 10:
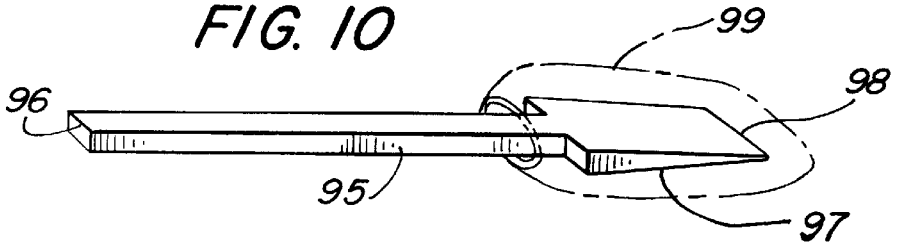
Figure 11:
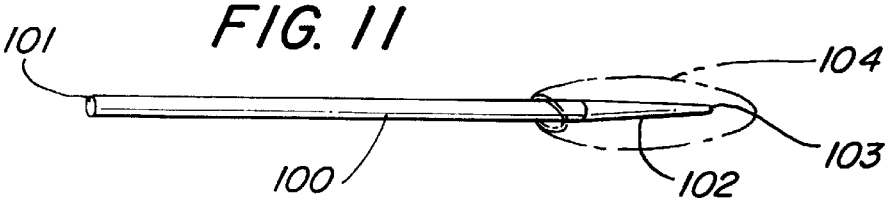

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a nail polish cleanup stick having moisture-retaining package constructed in accordance with the present invention;

FIG. 2 sets forth a side elevation view of the nail polish cleanup stick of FIG. 1;

FIG. 3 sets forth a top view of the nail polish cleanup stick of FIG. 1 being initially prepared for use;

FIG. 4 sets forth the top view of the present invention nail polish cleanup stick of FIG. 3 following the completion of opening its foil package in preparation for use;

FIG. 5 sets forth a perspective view of an alternate embodiment of the present invention nail polish cleanup sticks;

FIG. 6 sets forth a perspective view of a still further alternate embodiment of the present invention nail polish cleanup stick;

FIG. 7 sets forth a perspective view of the nail polish cleanup stick of FIG. 6 during an initial step of preparation for use;

FIG. 8 sets forth a perspective view of the nail polish cleanup stick of FIG. 6 following completion of its preparation for use;

FIG. 9 sets forth a perspective view of a still further alternate embodiment of the present invention nail polish cleanup stick;

FIG. 10 sets forth a perspective view of a still further alternate embodiment of the present invention nail polish cleanup stick;

FIG. 11 sets forth a perspective view of a still further alternate embodiment of the present invention nail polish cleanup stick;

DESCRIPTION OF THE PREFERRED EMBODIMENTS

FIG. 1 sets forth a perspective view of a cleanup stick having a moisture-retaining package constructed in accordance with the present invention and generally referenced by numeral 10. Cleanup stick 10 includes an elongated stick 11 preferably formed of somewhat resilient but substantially rigid material such as wood or molded plastic or the like, includes and end 12 and an end 13. End 13 is generally tapered or pointed and supports a pad 14 formed of an absorbent material such as cotton or the like. Cleanup stick 10 further includes a package 20 formed of a pair of layers 21 and 22. End 13 and absorbent pad 14 are received between layers 21 and 22. Layers 21 and 22 are preferably formed of a moisture-retaining material such as foil packaging or the like. Package 20 is formed by placing layers 21 and 22 in an overlying relationship and thereafter sealing outer edges 23, 24, 25 and 26 to secure a portion of stick 11 and end 13 together with absorbent pad 14 within the interior of the pocket thus formed. The sealing attachment of layers 21 and 22 may utilize a conventional adhesive such as the adhesives or attachment means presently used in similar products such as individually package alcohol pads or individually packaged moisturized cleanup toweletts. Thus, in accordance with the present invention, the moisture-retaining quality of package 20 is utilized to contain a quantity of solvent 15 which is absorbed within absorbent pad 14. As a result, cleanup stick 10 is ready for use by simply removing package 20 to withdraw interior end 13 of stick 11 and absorbent pad 14 having a quantity of solvent 15 absorbed therein. The selection of solvent 15 is a matter of design choice. However, the most typically used solvent for nail polish removal and cleanup is provided by materials such as acetone or the like.

In accordance with the present invention, the pre-moistened solvent bearing cleanup stick enclosed with package 20 is readily carried during periods of travel or other periods when the need for convenience arises. In addition however, it has been found that the use of the present invention pre-moistened cleanup stick is not limited to such situations but is, in fact, convenient for use in both professional and amateur nail decorating situations.

FIG. 2 sets forth a side elevation view of cleanup stick 10. As described above, cleanup stick 10 includes a stick 11 having an outer end 12 and an interior end 13 (seen in FIG. 1) end 13 supports an absorbent pad 14. A package 20 is formed by a pair of overlying layers of moisture-retaining material 21 and 22. Layers 21 and 22 captivate pad 14 and are sealed along their outer edges 23, 24, 25 (seen in FIG. 1) and 26.

FIG. 3 sets forth a top view of cleanup stick 10 showing the initial stage of opening package 20 to remove stick 11 for use. As described above, cleanup stick 10 includes a stick 11 having an interior end 12 and a pad of absorbent material 14. Cleanup stick further includes a package 20 formed of overlying layers 21 and 22 (seen in FIG. 1). Layers 21 and 22 are sealed at edges 23, 24, 25 and 26 to provide a moisture-retaining pocket in which a portion of stick 11 and absorbent pad 14 together with a small quantity of solvent 15 (seen in FIG. 1) is maintained.

In the operation depicted in FIG. 3, a corner 30 of layer 21 is separated from the corresponding portion of layer 22 and is pealed away from layer 22 in the direction indicated by arrow 31. As this process continues, a sufficient separation of layers 21 and 22 to allow stick 11 and pad 14 to be withdrawn from package 20.

FIG. 4 sets forth cleanup stick 10 following the completion of the above initiated package opening. Thus, as described above, cleanup stick 10 includes a stick 11 having an outer end 12 and a pad 14 supported thereon. A quantity of solvent 15 is retained and absorbed by pad 14. Package 20 includes a layer 21 and a layer 22 having outer edges 23, 24, 25 and 26. As can be seen, layer 21 is pealed substantially away from layer 22 as layer 21 is drawn in the direction indicated by arrow 33. At this point, stick 11 and pad 14 are readily withdrawn from package 20 and the solvent quantity absorbed within pad 14 may be utilized to clean excess nail polish from skin surrounding the user's nails as described above. Thereafter, package 20 and stick 11 may simply be discarded since each is fully disposable.

FIG. 5 sets forth a convenient variation of the present invention nail polish cleanup stick in which a plurality of cleanup sticks substantially identical to cleanup stick 10 shown in FIG. 1 are formed as a continuous strip 40. Thus, strip 40 includes a plurality of nail polish cleanup sticks serially joined to form a easily carried and easily transported strip of cleanup sticks. Thus, strip 40 includes a plurality of nail polish cleanup sticks such as cleanup sticks 41 through 48 having respective moisture-retaining packages 51 through 58 within which a plurality of sticks 61 through 68 support respective moisture absorbing pads (not shown) which are fabricated in manner seen in FIG. 1. In further accordance with the present invention, moisture-retaining packages 51 through 58 are joined in serial fashion to form strip 40 by interposed tear seams 71 through 78. A coiled end 50 of strip 40 supports a further plurality of cleanup sticks.

In operation, a portion of strip 40 is extended to facilitate the removal of the end one of the plurality of cleanup sticks in the strip by simply tearing at its respective tear seam. In the example of FIG. 5, cleanup stick 41 is removed from cleanup stick 42 by simply tearing package 41 away from package 42 in the manner indicated by arrow 39. Thereafter, the remainder of strip 40 may be wrapped upon coiled end 50 for further transportation or use. Cleanup stick 41 may then be readied for use in the manner set forth above in FIGS. 2 through 4 and thereafter be discarded.

Thus, it will be apparent to those skilled in the art, that the present invention nail polish cleanup stick having moisture-retaining package is convenient for use and overcomes many of the difficulties associated with use and transport of prior art methods of utilizing solvent to remove excess nail polish and the like.

It will be apparent to those skilled in the art, that differently shaped moisture-retaining packages may be utilized in accordance with the present invention without departing from the spirit and scope of thereof. Thus, by way of example, an alternative embodiment utilizing a differently shaped package is set forth in FIGS. 6, 7 and 8 and is generally referenced by numeral 80. In essence, the embodiment of FIGS. 6, 7 and 8 differs primarily in the manner in which the moisture retaining package is formed and the manner in which the solvent bearing cleanup stick may be removed from its package for use.

More specifically, FIG. 6 sets forth cleanup stick 80 having a stick 81 defining an outer end 82 and an inner end 83. End 83 supports an absorbent pad 84. In accordance with the present invention and as is illustrated in FIG. 1, a quantity of solvent will be understood to be absorbed within pad 84. Cleanup stick 80 includes a package 85 having a generally tubular shape defining sealed ends 86 and 87. The use of a tubular shape for package 85 allows the reduction of the amount of package edge which must be sealed. In some environments this fabrication has been found advantageous.

In operation, cleanup stick 80 may be prepared for use by simply grasping tube package 85 and drawing stick 81 outwardly therefrom in the direction indicated by arrow 89. This requires sufficient force to separate the seal of end 86. Alternatively however, cleanup stick 80 may be prepared for use by simply grasping package 85 and forcing end 82 of stick 81 against a convenient surface such as a countertop or the like. The results of this method of opening cleanup stick 80 are set forth below in FIG. 7.

FIG. 7 shows cleanup stick 80 following the above described opening operation as end 82 of stick 81 is forced against a convenient surface.

More specifically, cleanup stick 80 includes a stick 81 having an end 82 and an end 83. End 83 supports an absorbent pad 84. Cleanup stick 80 further includes a tubular package 85 having sealed ends 86 and 87. In the operation shown in FIG. 7, end 82 has been forced inwardly relative to package 85 such that stick 81 and pad 84 are forced outwardly in the direction indicated by arrow 88 overcoming the seal of sealed end 87. Thereafter, stick 81 supporting absorbent pad 84 having a quantity of solvent absorbed therein may simply be further withdrawn from package 85 and package 85 may be discarded.

FIG. 8 sets forth the completion of this preparation process for cleanup stick 80. Thus, cleanup stick 80 includes a tubular package 85 having sealed ends 86 and 87 and a stick 81. Stick 81 includes an end 82 and an absorbent pad 84. In the configuration shown in FIG. 8, stick 81 has been fully removed from package 85 by withdrawing it in the direction indicated by arrow 88. Thereafter, package 85 is discarded and stick 81 having solvent bearing pad 84 supported thereon may be used as described above.

It will be equally apparent to those skilled in the art, that in addition to variations of the shape of moisture-retaining packages to be utilized in accordance with the present invention, the shape and configuration of the stick and absorbent pad may also be varied without departing from the spirit and scope of the present invention. Accordingly, by way of illustration and not limitation, FIGS. 9, 10 and 11 set forth below set forth below show examples of variations of stick and absorbent pad design utilized in the present invention. However, it must be emphasized that the embodiments shown in FIGS. 1 through 8 as well as the alternate embodiments set forth below in FIGS. 9, 10 and 11 are for illustration only and are by no means limitations of the shape of stick or absorbent pad which may be used without departing from the spirit and scope of the invention.

FIG. 9 sets forth a stick 90 having a substantially flat rectangular cross-section and defining an outer end 91 and a generally tapered end 92. Tapered end 92 terminates in a generally flat blade edge 93. An absorbent pad 94 is shown in phantom line depiction upon end 92. It will be understood that the intended use of stick 90 and pad 94 is in accordance with the above described enclosure within a moisture-retaining package as shown in FIG. 1 or alternatively as shown in FIG. 6.

FIG. 10 shows a further alternate embodiment of the present invention having a stick 95 defining a generally square cross-section and having an outer end 96. Stick 95 further supports a broad wedge shaped end 97 having a blade edge 98 formed thereon. An absorbent pad 99 shown in phantom line depiction encloses end 97. Once again, it will be understood that stick 95 and pad 99 are intended to be supported within a moisture-retaining package as described above.

FIG. 11 sets forth a still further alternate embodiment of the present invention having a stick 100 defining a generally cylindrical body having an outer end 101 and a tapered pointed end 102. End 102 terminates in a sharp pointed end 103. A pad of absorbent material 104 is received upon end 102. Stick 100 is intended to show an embodiment suitable for use in extremely precise removal of small amounts of excess nail polish where great precision is required. Once again it will be understood that the intended use of stick 100 and pad 104 is the enclosure within an individual moisture-retaining package in the manner set forth above in FIG. 1 or in an alternative shape package such as the package set forth above in FIG. 6. Further package shapes may, of course, be used as mentioned above.

What has been shown is a nail polish cleanup stick having a moisture-retaining package which greatly increases the convenience of use solvent materials in cleaning up excess nail polish from the user's skin. The improved nail polish cleanup stick of the present invention provides individual moisture-retaining packages about each absorbent pad and a quantity of solvent absorbed in the pad maintained within the package. While the present invention is particularly advantageous in circumstances of convenience such as travel or the like, it has been found to provide sufficient improvement in convenience of use to be advantageous in virtually all other nail environments where nail polish is applied and where excess nail polish must from time to time be removed.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A nail polish clean up stick having a moisture-retaining package comprising:

an elongated stick having an interior end and an exterior end;

a pad of absorbent material supported upon said interior end;

a moisture-retaining package defining an interior pocket enclosure and sealed outer edges, said interior end and absorbent pad extending into said interior pocket; and a small quantity of nail polish dissolving solvent absorbed into said absorbent pad, said elongated stick and said absorbent pad being removable from said moisture-retaining package to apply said solvent to excess nail polish from a user's skin.

2. The nail polish cleanup stick having a moisture-retaining package set forth in claim 1 wherein said package is formed of a metal foil material.

3. The nail polish cleanup stick having a moisture-retaining package set forth in claim 2 wherein said package is formed of a pair of overlying layers having edges joined to form said interior pocket enclosure.

4. The nail polish cleanup stick having a moisture-retaining package set forth in claim 3 wherein a plurality of said packages each having one of said interior ends and absorbent pads therein are joined to each other by interposed tearable seams to form a strip of said cleanup sticks.

5. The nail polish cleanup stick having a moisture-retaining package set forth in claim 2 wherein said package is formed of a tube having said interior pocket being formed between opposed sealed ends.

* * * * *